US008808534B2

(12) United States Patent
Ercan et al.

(10) Patent No.: US 8,808,534 B2
(45) Date of Patent: Aug. 19, 2014

(54) PROCESS DEVELOPMENT BY PARALLEL OPERATION OF PARAFFIN ISOMERIZATION UNIT WITH REFORMER

(75) Inventors: Cemal Ercan, Dhahran (SA); Yuguo Wang, Dhahran (SA); Mohammad R. Al-Dossary, Khobar (SA); Rashid M. Al-Othman, Khobar (SA)

(73) Assignee: Saudi Arabian Oil Company (SA)

( * ) Notice: Subject to any disclaimer, the term of this patent is extended or adjusted under 35 U.S.C. 154(b) by 603 days.

(21) Appl. No.: 13/192,062

(22) Filed: Jul. 27, 2011

(65) Prior Publication Data

US 2013/0026066 A1 Jan. 31, 2013

(51) Int. Cl.
*C10G 35/02* (2006.01)

(52) U.S. Cl.
USPC ..... 208/79; 208/78; 208/133; 208/134; 208/141

(58) Field of Classification Search
USPC ..... 208/78–79, 133–134, 141
See application file for complete search history.

(56) References Cited

U.S. PATENT DOCUMENTS

| | | | | |
|---|---|---|---|---|
| 4,105,707 | A | | 8/1978 | Little et al. |
| 4,432,862 | A | | 2/1984 | Swart et al. |
| 4,747,933 | A | | 5/1988 | Hibbs |
| 4,804,802 | A | | 2/1989 | Evans et al. |
| 4,855,529 | A | | 8/1989 | Stem et al. |
| 4,911,822 | A | | 3/1990 | Franck et al. |
| 4,982,048 | A | | 1/1991 | Stem et al. |
| 5,043,525 | A | | 8/1991 | Haizmann et al. |
| 5,059,741 | A | | 10/1991 | Foley |
| 5,091,074 | A | | 2/1992 | Maxwell et al. |
| 5,242,576 | A | * | 9/1993 | Schmidt et al. ..... 208/78 |
| 5,294,328 | A | | 3/1994 | Schmidt et al. |
| 5,334,792 | A | | 8/1994 | Del Rossi et al. |
| 5,602,291 | A | | 2/1997 | Minkkinen et al. |
| 5,831,139 | A | | 11/1998 | Schmidt et al. |
| 6,759,563 | B1 | | 7/2004 | Hibbs |
| 6,927,314 | B1 | | 8/2005 | Schultz et al. |
| 7,485,768 | B1 | | 2/2009 | Rice et al. |
| 2004/0154415 | A1 | | 8/2004 | Kebart et al. |
| 2006/0065576 | A1 | | 3/2006 | Broutin et al. |

FOREIGN PATENT DOCUMENTS

| | | | |
|---|---|---|---|
| EP | 0554945 | A1 | 8/1993 |
| EP | 0629683 | A1 | 12/1994 |

OTHER PUBLICATIONS

International Search Report and Written Opinion issued Oct. 4, 2012 in PCT/US2012/046449 (16 pages).

* cited by examiner

*Primary Examiner* — Brian McCaig
(74) *Attorney, Agent, or Firm* — Bracewell & Giuliani LLP; Constance G. Rhebergen

(57) ABSTRACT

A process for refining naphtha that results in an improved octane value in a subsequent gasoline blend. Certain embodiments include separating a naphtha feed into light naphtha and heavy naphtha; separating the heavy naphtha into a paraffin stream and non-paraffin stream; introducing the light naphtha to a first isomerization unit, introducing the paraffin stream to a second isomerization unit; introducing the non-paraffin stream to a reforming unit and combining the resulting effluents to form a gasoline blend. The resulting gasoline blend has improved characteristics over gasoline blends that are made without introducing the paraffin stream to a second isomerization unit.

18 Claims, 5 Drawing Sheets

PROCESS DEVELOPMENT BY PARALLEL OPERATION OF PARAFFIN ISOMERIZATION UNIT WITH REFORMER

TECHNICAL FIELD OF THE INVENTION

The present invention relates to a process for refining naphtha. More specifically, embodiments of the present invention utilize two isomerization units and a reforming unit to create a gasoline blend having an improved octane rating as compared to the naphtha and/or to produce concentrated reformate for petrochemicals.

BACKGROUND OF THE INVENTION

Gasoline is a complex mixture of hydrocarbons generally having 4-12 carbon atoms and a boiling point in the range of about 35-200° C. It is a blend of multiple refinery streams, which fulfill certain specifications dictated by both performance requirements and government regulations. Typical gasoline blending streams, which usually include octane booster additives (oxygenate), such as methyl tert-butyl ether (MTBE) or tetra-ethyl lead, are presented in Table I.

TABLE I

Typical Gasoline Blending Components

| Blending Component | Gasoline (vol %) | |
|---|---|---|
| FCC Gasoline (naphtha) | 30-50 | has ~30 vol& aromatics and 20-30 vol % olefins |
| LSR Gasoline (naphtha) | 2-5 | |
| Alkylate | 10-15 | |
| Oxtane booster additive (oxygenates such as MTBE) | 10-15 | |
| Butanes | <5 | |
| Reformate | 20-40 | has 60-65 vol % aromatics |
| Isomerate ($C_5/C_6$) | 5-10 | |

Generally, FCC naphtha and reformate make up approximately two-third of gasoline. Since FCC naphtha and reformate contain high levels of aromatics and olefins, they are also the major octane sources for gasoline.

FIG. 1 represents a simplified perspective view of a process diagram according to an embodiment of the prior art. Naphtha feed 2 is introduced into first separator 10, where it is then split into light naphtha 12 and heavy naphtha 14. Light naphtha 12 generally contains mostly $C_5$ and $C_6$ paraffins. Light naphtha 12 is then introduced into first isomerization unit 20 in order to isomerize light naphtha 12 to form light isomerate 22. Heavy naphtha 14 enters reforming unit 30, where heavy naphtha 14 is reformed to reformate 32. Light isomerate 22 and reformate 32 are then blended together in gasoline blender 40 to form gasoline blend 42.

Over the years, safety and environmental concerns have caused gasoline specifications to change. For example, European gasoline specifications from 1995 to 2005 are presented in Table-2, which shows a gradual change of the gasoline specifications over the years. A similar trend is also observed in the other parts of the world.

TABLE II

European Commission Gasoline Specifications

| Parameter | 1995 | 2000 | 2005 | 2005+ |
|---|---|---|---|---|
| Octane number; RON | — | 95 | 95 | 95 |
| Aromatic, vol % | — | 42 | 35 | <35 |
| Benzene, vol % | 5 | 1 | 1 | <1 |
| Sulfur, ppmw | 1000 | 150 | 50/10 | <10 |
| Olefins, vol % | — | 18 | 18 | 10 |
| Oxygen, wt % max | 2.7 | 2.7 | 2.7 | — |
| Rvp, psi | — | 8.7 | 8.7 | 8.7 |

Table II also shows that there is a gradual decrease in aromatic, olefin, and benzene levels while keeping high octane value. The United States already requires aromatic levels of less than 30 vol %, with benzene levels being limited to 0.8%. Furthermore, the aromatic level in gasoline will also be lowered, particularly as distillation end points (usually characterized as the 90% distillation temperature) are lowered since the high boiling point portion of gasoline (which is largely aromatic) would thereby be eliminated. Furthermore, since aromatics are the principle source of octane, decreasing aromatics level will create an octane gap in the gasoline pool. As such, octane-barrel maintenance will continue to be a challenge for refineries.

As aromatic content of gasoline goes down, the portion of reformate in the gasoline poll has to go down accordingly since reformate is mostly aromatics. Therefore, refineries can no longer heavily rely on aromatics as octane source. An ecologically sound way to increase the octane number is by increasing the concentration of the branched alkanes at the expense of normal paraffins. Consequently, an increase in iso-alkanes with high octane number is desirable.

It would be desirable to have an improved process for refining naphtha that resulted in an improved gasoline blending streams and/or to produce concentrated reformate for petrochemicals.

SUMMARY OF THE INVENTION

The present invention is directed to a process that satisfies at least one of these needs. In one embodiment, the process for refining naphtha includes the steps of separating a naphtha feed into a light naphtha and a heavy naphtha, introducing the light naphtha to a first isomerization unit under first isomerization conditions to produce a light isomerate, separating the heavy naphtha into a heavy n-paraffin and a heavy non-paraffin (which can include a heavy non-paraffinic naphtha), introducing the heavy n-paraffin to a second isomerization unit under second isomerization conditions to produce a heavy isomerate, introducing the heavy non-paraffin to a reforming unit under reforming conditions to produce a reformate, and combining at least a portion of each of the light isomerate, the heavy isomerate, and the reformate to form a gasoline blend. Advantageously, the gasoline blend has an increased octane rating as compared to a second gasoline blend formed without introducing the heavy n-paraffin to the second isomerization unit under second isomerization conditions. In one embodiment, the gasoline blend has a target octane rating of at least 90. In one embodiment, the gasoline blend has a target octane rating of more than 100, and more preferably target octane rating of about 120.

Preferably, the light naphtha includes paraffins having 6 or fewer carbon atoms, and more preferably, 5 or 6 carbon atoms. In one embodiment, the first isomerization is a $C_5/C_6$ isomerization unit. Preferably, the heavy n-paraffin includes paraffins having more than 6 carbon atoms and less than 13 carbon atoms, more preferably between 7 and 12 carbon atoms, inclusive, and even more preferably, between 7 and 11 carbon atoms, inclusive. Preferably, the heavy non-paraffin includes non-paraffins having more than 6 carbon atoms and less than 13 carbon atoms, more preferably between 7 and 12 carbon atoms, inclusive, and even more preferably, between 7 and 11 carbon atoms, inclusive.

In one embodiment, the heavy n-paraffin stream is separated from the heavy naphtha stream using molecular sieve adsorption, distillation, extraction, or combinations thereof. In another embodiment, the heavy isomerate includes branched paraffins, such that the heavy isomerate contains more branched paraffins as compared to the heavy n-paraffin. In another embodiment, the process can include the step of introducing at least a portion of the reformate to a refinery as an aromatics source. In another embodiment, the gasoline blend has improved characteristics, characterized by an octane rating within the range of 90 to 97, an aromatic concentration below 35% volume, and a benzene concentration below 0.8% volume. In another embodiment, the gasoline blend includes less than 30% by volume aromatics.

In one embodiment, the first isomerization conditions include the first isomerization unit maintaining a first isomerization temperature within the range of 100° C. and 300° C., and the first isomerization unit maintaining a first isomerization pressure within the range of 275 psig and 450 psig. In another embodiment, the second isomerization conditions include the second isomerization unit maintaining a second isomerization temperature within the range of 100° C. and 300° C., and the second isomerization unit maintaining a second isomerization pressure within the range of 300 psig and 700 psig. In another embodiment, the reforming conditions include the reforming unit maintaining a reforming temperature within the range of 450° C. and 550° C., and the reforming unit maintaining a reforming pressure within the range of 70 and 300 psig. In one embodiment, the invention advantageously allows for the reforming temperature to be about 10° C. to 30° C. below a typical reformer due to the removal of the n-paraffins.

In an additional embodiment of the present invention, a process for refining naphtha includes the steps of separating a naphtha feed into a light naphtha and a heavy naphtha; introducing the light naphtha to a first isomerization unit under first isomerization conditions to produce a light isomerate; separating the heavy naphtha into a heavy n-paraffin and a heavy non-paraffin; introducing the heavy n-paraffin to a second isomerization unit under second isomerization conditions to produce a heavy isomerate; introducing the heavy non-paraffin stream to a reforming unit under reforming conditions to produce a reformate; and combining at least a portion of each of the light isomerate, the heavy isomerate, and the reformate to form a gasoline blend, wherein the gasoline blend has improved characteristics, characterized by an octane rating within the range of 90 to 97, an aromatic concentration below 35% volume, and a benzene concentration below 0.8% volume, wherein the light naphtha comprises paraffins having 5 or 6 carbon atoms, wherein the first isomerization conditions comprise a first isomerization temperature within the range of 100° C. and 300° C. and a first isomerization pressure within the range of 275 psig and 450 psig, wherein the heavy non-paraffin comprises non-paraffins having more than 6 carbon atoms and less than 11 carbon atoms, wherein the heavy n-paraffin comprises paraffins having more than 6 carbon atoms and less than 11 carbon atoms, wherein the heavy isomerate comprises branched paraffins having increased octane values as compared to the heavy n-paraffin, wherein the second isomerization conditions comprise a second isomerization temperature within the range of 100° C. and 300° C. and a second isomerization pressure within the range of 300 psig and 700 psig, wherein the reforming conditions comprise a reforming temperature within the range of 450° C. and 550° C. and a reforming pressure within the range of 70 psig and 300 psig. In an additional embodiment, the heavy n-paraffin stream can be separated from the heavy naphtha stream using molecular sieve adsorption, distillation, extraction, or combinations thereof.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Taking into account the environmental regulations and streams in gasoline compositions, it would be advantageous to shift the hydrocarbon composition of fuel from aromatics and olefins to naphthenes and branched paraffins in order to maintain beneficial octane number ratings while minimizing pollutants associated with aromatics and olefins.

In one embodiment, the process for refining naphtha includes the steps of separating a naphtha feed into light naphtha and heavy naphtha; separating the heavy naphtha into a paraffin stream and non-paraffin stream; introducing the light naphtha to a first isomerization unit, introducing the paraffin stream to a second isomerization unit; introducing the non-paraffin stream to a reforming unit and combining the resulting effluents to form a gasoline blend. The resulting gasoline blend has improved characteristics over gasoline blends that are made without introducing the paraffin stream to a second isomerization unit.

Reformer

Figure 2:
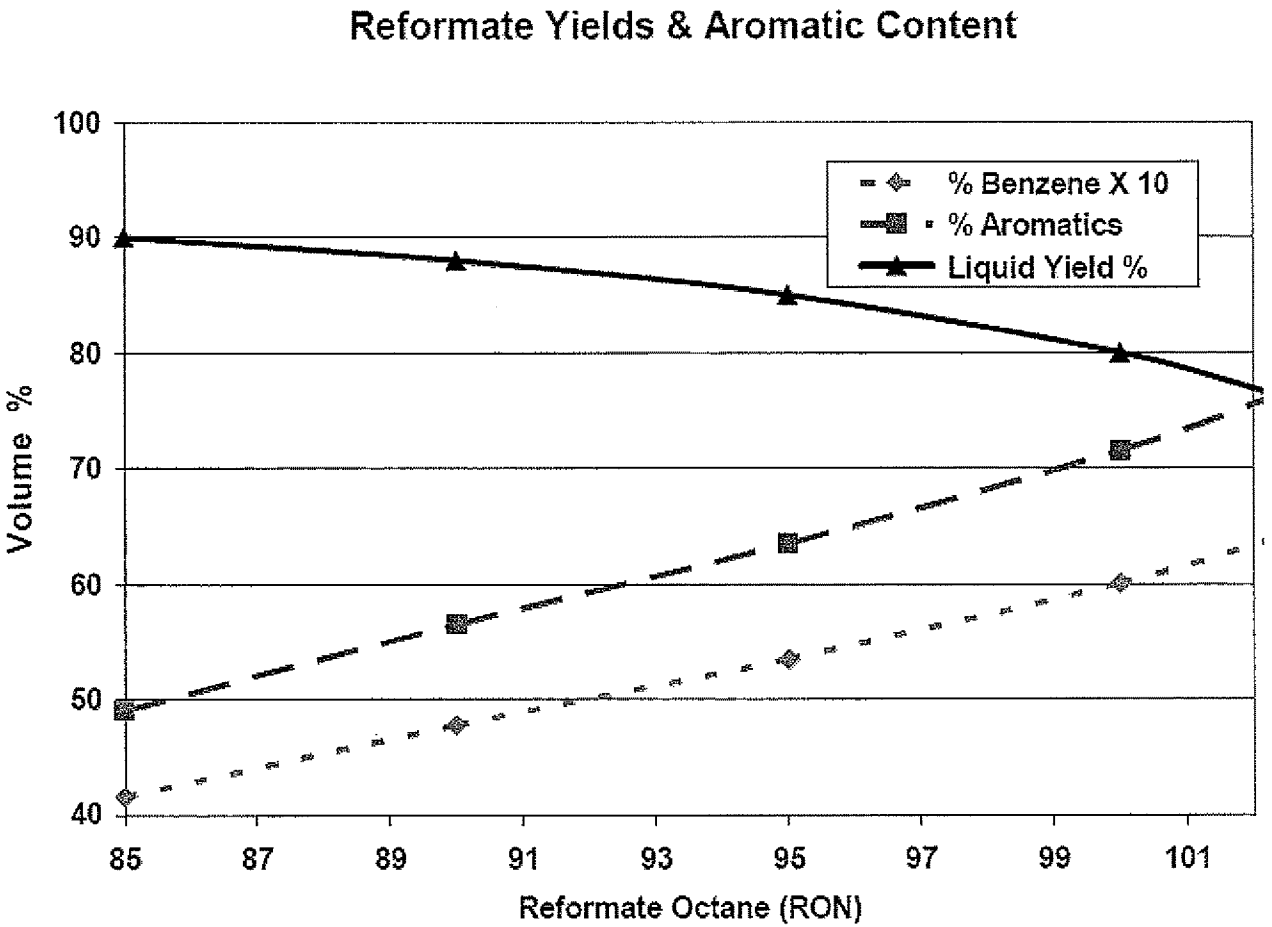
FIG. 2 is a graphical representation of reformer liquid yields as a function of reformate octane.

As mentioned above, the reformate with high aromatic content is typically the main octane source for gasoline provided in the conventional manner. The conventional feed to a reformer (e.g., heavy naphtha) contains mostly $C_7$-$C_{11}$ paraffins (P), naphthenes (N) and aromatics (A). The purpose of reforming is to produce aromatics from naphthenes and paraffins that are useful in various applications. Among these group of chemicals, aromatics pass through the reactor largely unchanged, and naphthenes dehydrogenate to aromatics rapidly and efficiently. Therefore, naphthene conversion goes mostly to completion at the initial part of the reactor (or in the first reactor of a multi-reactor reformer) even at less severe operation (mild temperature). However, paraffins are very difficult to convert, as they require a higher temperature and a longer residence time. Some conversion of paraffins occurs towards the end of reactor system at high severity operating conditions, which is mostly cracking into light gases. Therefore, to increase the paraffin conversion, high severity operation is needed. However, this decreases liquid yield due to excessive cracking. As shown in FIG. 2, although octane number increases due to concentrated aromatic content a substantial liquid yield loss is observed.

TABLE III

Relative Reaction Rates for $C_6$ & $C_7$ Hydrocarbons

| | Paraffin | | Alkycyclo-pentanes | | Alkycyclo-hexanes | |
|---|---|---|---|---|---|---|
| Reaction Type | $C_6$ | $C_7$ | $C_6$ | $C_7$ | $C_6$ | $C_7$ |
| Isomerization | 10.0 | 13.0 | 10.0 | 13.0 | — | — |
| Dehydrodecyclization | 1.0 | 4.0 | — | — | — | — |
| Hydrocracking | 3.0 | 4.0 | — | — | — | — |
| Decyclization | — | — | 5.0 | 3.0 | — | — |
| Dehydrogenation | — | — | — | — | 100.0 | 120.0 |

*All rates relative to the rate of dehydrocyclization of normal hexane

Table III summarizes the relative rates of $C_6$ and $C_7$ paraffins and naphthenes at reforming conditions (pressure: 70-300 psig; temperature: 450-550° C.; and hydrogen to hydrocarbon mole ratio ("$H_2$/HC"):5-7). The reaction rates of paraffins for all possible reactions are relatively slow, particularly when compared with the reaction rates for the dehydrogenation of alkycyclohexanes, Liquid yield loss is primarily attributable to the cracking of paraffins. Additionally, isomerization of paraffins is very low at reforming temperatures because isomerization is an equilibrium reaction, and low temperature favors branched paraffins. Conversely, dehydrogenation of naphthenes to aromatics is fast and proceeds almost to completion. The reaction for naphthene dehydrogenation to aromatics is several times higher than that of dehydrocyclization of paraffins. Therefore, in a conventional reformer, aromatics (and octane) are primarily made via the dehydrogenation of naphthene. Additionally, hydrogen is also produced primarily by this reaction.

Figure 3:
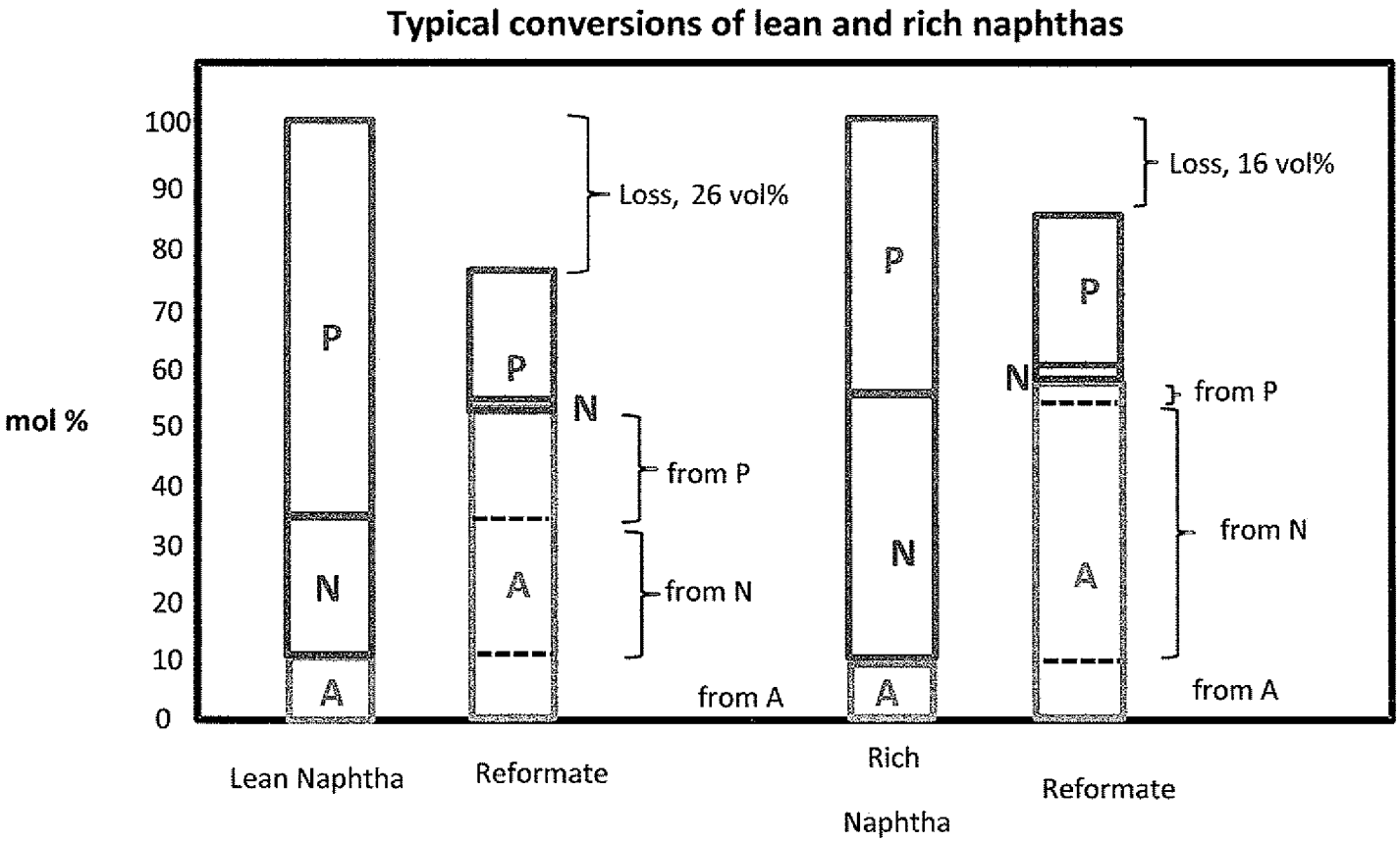
FIG. 3 is a graphical representation of typical conversions for lean and rich naphthas.

Naphtha feed to the reformer can be categorized into "lean-naphtha" and "rich-naphtha" depending on the paraffin concentration in the feedstock. The naphtha with high concentration of paraffins is sometimes referred to as "lean-naphtha." Lean naphtha is difficult to process and typically produces too many light hydrocarbons, thereby producing an overall low liquid yield. The naphtha with low concentration of paraffins is sometimes referred to as "rich-naphtha," which is relatively easier to process and has a higher liquid yield. As such, Rich-naphtha makes the reforming unit's operation much easier and more efficient, and is, therefore, more desirable as a reformer feed than lean-naphtha. FIG. 3 schematically illustrates the typical conversions of lean- and rich-naphthas at typical reformer operating conditions. FIG. 3 indicates that for this typical case, the reformate produced from rich-naphtha has a liquid yield of approximately 10 wt % greater than the reformate produced using a lean-naphtha. Moreover, the reformate resulting from the rich-naphtha contains more aromatics than a reformate resulting from the lean naphtha, which will ultimately produce a gasoline blend having a higher octane number.

Typical heavy naphtha feed contains around 10-40% n-paraffins. Separating the n-paraffins from heavy naphtha with known methods such as adsorption, distillation, extraction, and the like will produce two feedstocks; namely n-paraffins ($C_{7+}$) for the second isomerization unit ($C_{7+}$ isomerization unit) and the remaining one without n-paraffins (non-paraffinic heavy naphtha), which will be more desirable feedstock for a reformer due to less paraffinic content. With the reduction of paraffins within the heavy non-paraffin, naphthene and aromatic content increases and the feedstock becomes rich-naphtha. The processing of this feedstock in a reforming unit will be easier and the performance of the reforming unit improves substantially; which is indicated by a higher liquid yield, lower reactor temperature (longer catalyst life), higher aromatics in reformate, and higher hydrogen concentration in off-gas.

Figure 4:
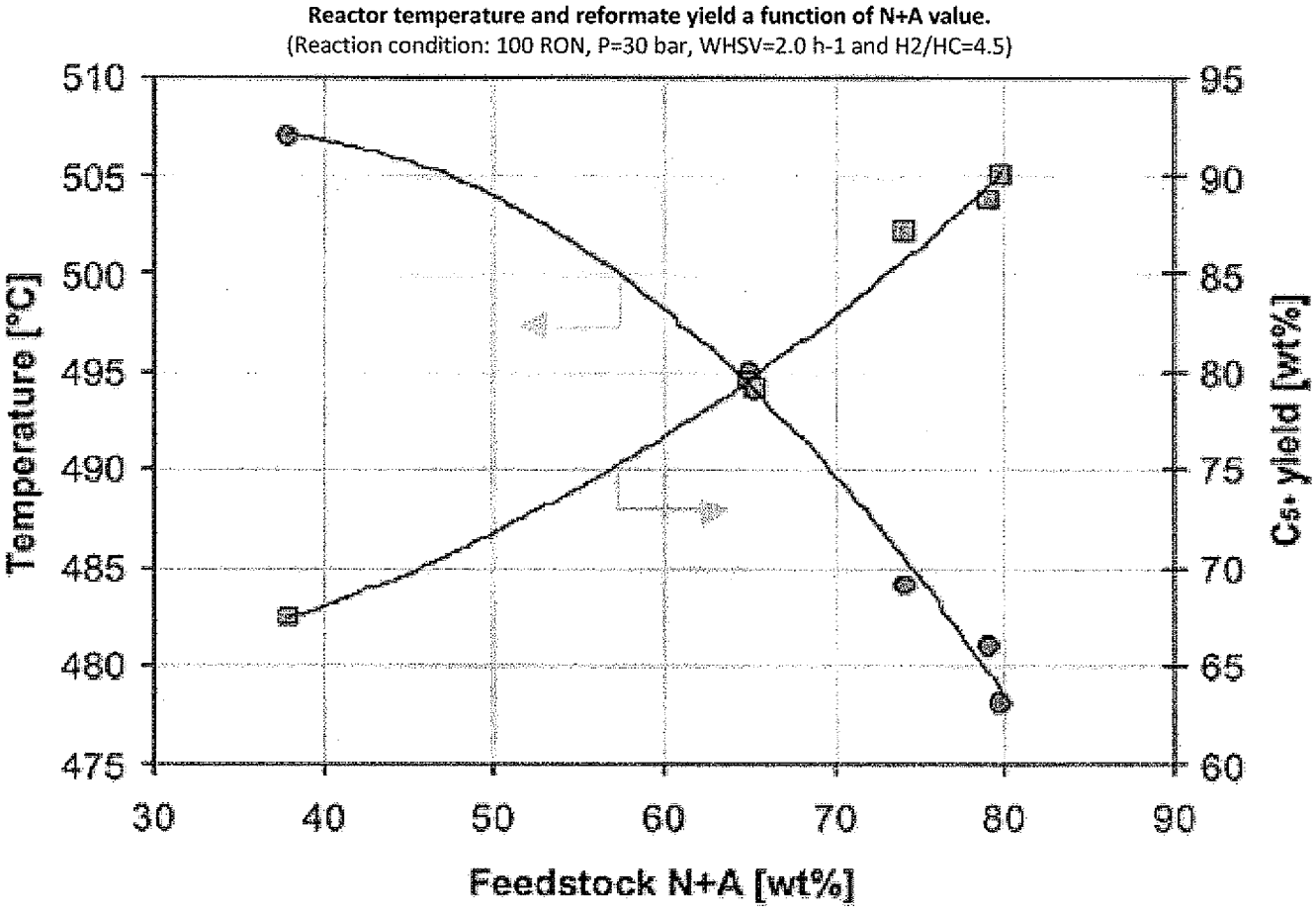
FIG. 4 is a graphical representation of reformer temperature and $C_{5+}$ liquid yield as a function of naphthene and aromatic content in the feedstock.

FIG. 4 shows the expected increase in liquid yield and decrease in operating temperature as a function of naphthene and aromatics in the feedstock. The points in FIG. 4 are the experimental data. Since lower temperatures favor isomers, the operating temperature of the reforming unit is not in the optimum temperature range for isomerization. Therefore, isomerization of $C_{7+}$ paraffins in a dedicated second isomerization unit will substantially improve isomerization while also minimizing cracking. Thus, certain embodiments of the present invention can substantially improve liquid yield and product quality with the following tangible benefits;

Improved reformer performance.

Increased aromatic content in reformate, thereby making the aromatic separation for petrochemical use easier.

Increased hydrogen concentration in off gas due to less cracking, thereby making hydrogen separation easier.

Increased isomerate quality with minimal cracking due to optimum operating conditions for $C_{7+}$ n-paraffins.

Reduced $H_2$ consumption due to less cracking

Figure 1:
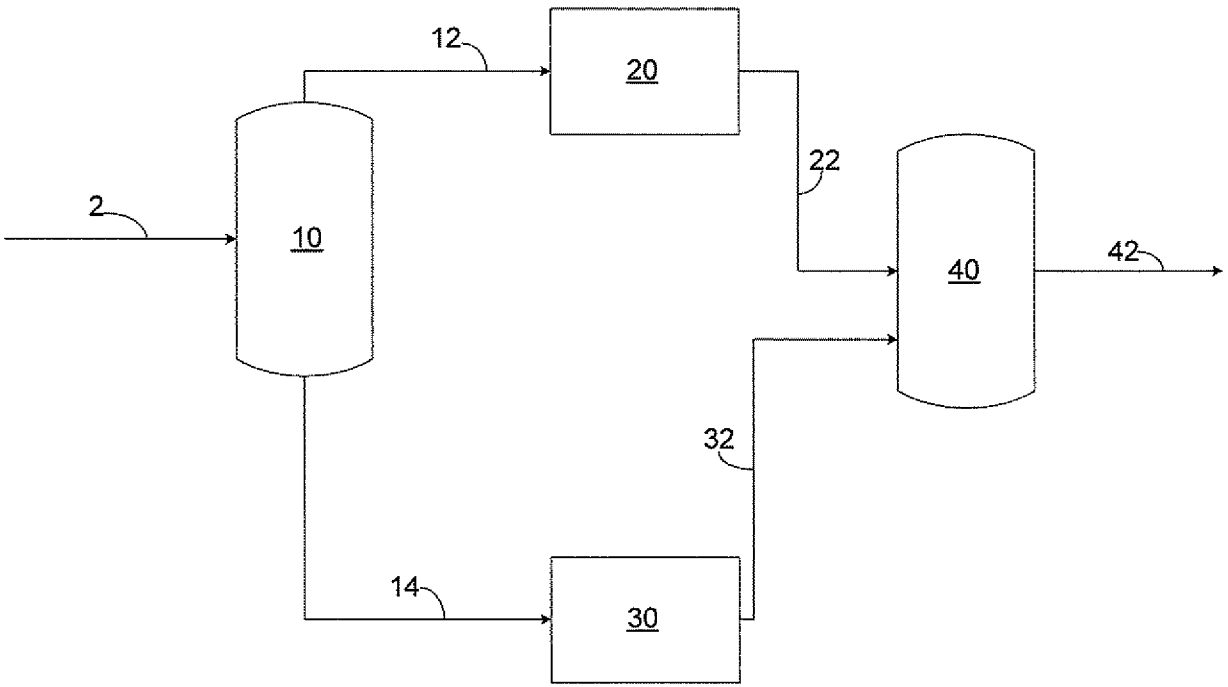
FIG. 1 (Prior Art)
FIG. 1 is a perspective view of a process diagram according to an embodiment of the prior art.
Figure 5:
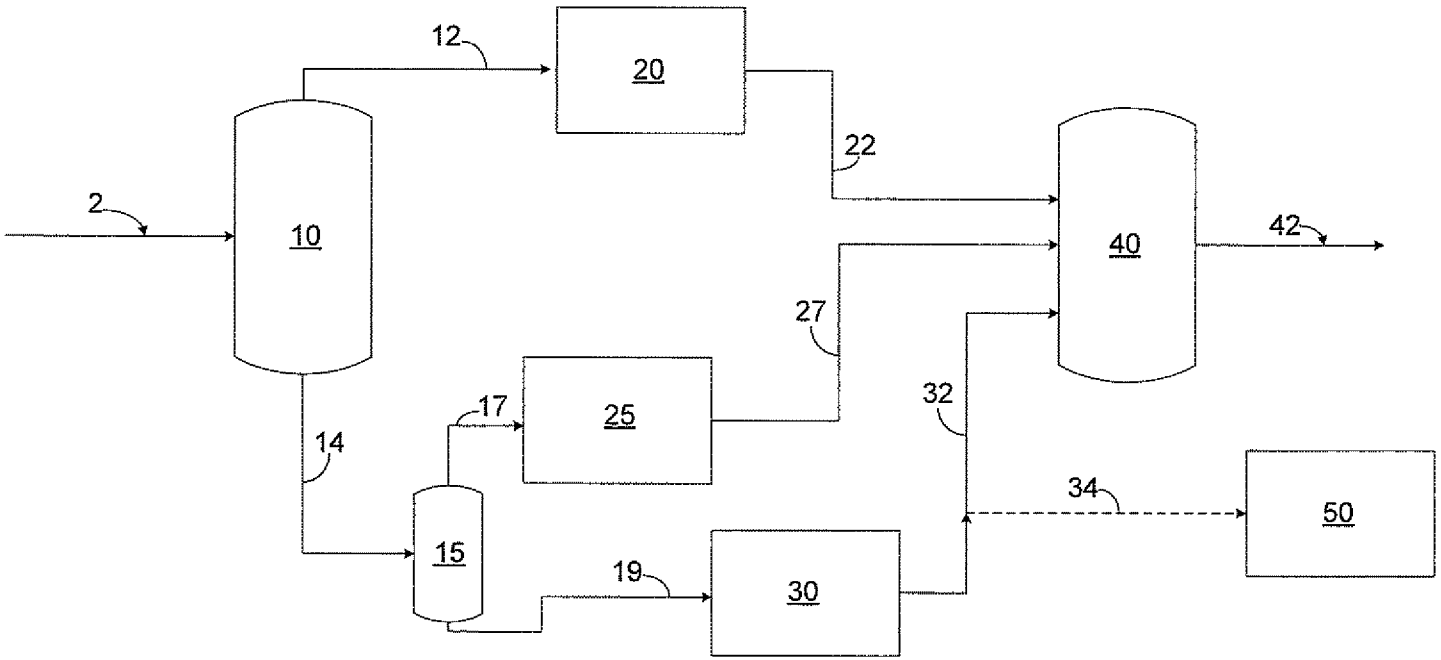
FIG. 5 is a perspective view of a process diagram according an embodiment of the present invention.

Now turning to FIG. 5. Naphtha feed 2 is introduced into first separator 10, where it is then split into light naphtha 12 and heavy naphtha 14. Light naphtha 12, which includes primarily $C_5$ and $C_6$ paraffins, is then introduced into first isomerization unit 20 in order to isomerize light naphtha 12 to form light isomerate 22. Heavy naphtha 14, which includes primarily $C_{7+}$ naphthas, enters second separator 15, where heavy naphtha 14 is split into two streams: heavy n-paraffin 17 and heavy non-paraffin 19. Those of ordinary skill in the art will understand that complete removal of paraffin is difficult, and therefore, heavy non-paraffin will likely include small amounts of n-paraffins. In any case, heavy non-paraffin 19 contains a substantially reduced amount of n-paraffins as compared with heavy naphtha 14. Heavy n-paraffin 17 enters second isomerization unit 25 in order to isomerize heavy n-paraffin 17 to form heavy isomerate 27. Heavy non-paraffin 19 is introduced into reforming unit 30, where heavy non-paraffin 19 is reformed to reformate 32. Light isomerate 22, heavy isomerate 27, and reformate 32 are then blended together in gasoline blender 40 to form gasoline blend 42. In this embodiment, gasoline blend 42 of FIG. 5 has improved characteristics as compared to gasoline blend 42 of FIG. 1. In an optional embodiment, slip stream 34 of reformate 32 can be sent to refinery 50 as an aromatics source.

Example #1

Refining Naphtha without Second Isomerization Unit

The following example represents a method practiced in accordance with those known in the prior art. 100 kg of heavy naphtha, of which 60 wt % were paraffins, 27.5 wt % were naphthenes, and 12.5 wt % were aromatics, was sent to a reformer under typical reforming conditions. The resulting reformate included 20.4 kg non-aromatics and 47.6 kg aromatics, thereby yielding a total liquid yield of 68 kg (or 68 weight % of the original feed) and a research octane number ("RON") of about 100. A summary of the results for Example #1 are shown in Table IV below:

TABLE IV

Data for Example #1 (Prior Art)

| | Weight (kg) | Weight % |
|---|---|---|
| Feedstock (Heavy Naphtha) | | |
| Paraffins | 60 | 60.0% |
| Naphthenes | 27.5 | 27.5% |
| Aromatics | 12.5 | 12.5% |
| Total | 100.0 | 100% |
| Reformate ($C_{5+}$ yield) | | |
| Non-aromatics | 20.4 | 30% |
| Aromatics | 47.6 | 70% |
| Total | 68.0 | 68% |

Example #2

Illustrative Embodiment of the Present Invention

The following is an example practiced in accordance with an embodiment of the present invention. A second sample of 100 kg of heavy naphtha, which was identical in composition as the heavy naphtha used in Example #1, was used as a feedstream. However, prior to sending the heavy naphtha to the reformer, approximately 40 kg of the paraffins (about 67%) were extracted from the heavy naphtha and sent to an isomerization unit. This left a 60 kg feedstream for the reformer. In this case, the reformer (because of the lower paraffin content) was operated at more mild conditions as compared to the reformer in Example #1 (approximately 10° C. to 20° C.), without reducing liquid yield. The resulting reformate included 13.4 kg non-aromatics and 40.6 kg aromatics; thereby yielding a total liquid yield of about 54 kg, which was about 90 weight % of the reformer feed. Furthermore, the second isomerization unit produced a total liquid yield of approximately 95 weight % (38 kg out of 40 kg). Therefore, the overall total liquid yield for both the isomerization unit and the reformer were approximately 92 weight % and had an RON of approximately 120. A summary of the results for Example #2 are shown in Table V below:

TABLE V

Data for Example #2 (Embodiment of the Present Invention)

| | Weight (kg) | Weight % |
|---|---|---|
| Feedstock (Reformer) | | |
| Paraffins | 20 | 33.3% |
| Naphthenes | 27.5 | 45.8% |
| Aromatics | 12.5 | 20.8% |
| Total | 60.0 | 100.0% |

TABLE V-continued

Data for Example #2 (Embodiment of the Present Invention)

| | Weight (kg) | Weight % |
|---|---|---|
| Reformate ($C_{5+}$ yield) | | |
| Non-aromatics | 13.4 | 25% |
| Aromatics | 40.6 | 75% |
| Total | 54.0 | 90% |
| Second Isomerization Unit | | |
| Heavy Paraffins (feedstream) | 40 | 100% |
| Isomerate (effluent) | 38 | 95% |

As shown above, Example #2 has increased liquid yields over Example #1 (92 wt % v. 68 wt %), as well as increased RON (120 v. 100) and more mild operating conditions. A summary of the advantages is shown Table VI below:

TABLE VI

Comparison of Example #1 and #2

| | Example #1 | Example #2 |
|---|---|---|
| Total Liquid Yields | 68 | 92 |
| RON | 100 | ~120 |

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps can be combined into a single step.

We claim:

1. A process for refining naphtha, the process comprising the steps of:

(a) separating a naphtha feed into a light naphtha and a heavy naphtha, wherein the light naphtha comprises paraffins having 6 or fewer carbon atoms;

(b) introducing the light naphtha to a first isomerization unit under first isomerization conditions to produce a light isomerate;

(c) separating the heavy naphtha into a heavy n-paraffin and a heavy non-paraffin;

(d) introducing the heavy n-paraffin to a second isomerization unit under second isomerization conditions to produce a heavy isomerate;

(e) introducing the heavy non-paraffin to a reforming unit under reforming conditions to produce a reformate; and (f) combining at least a portion of each of the light isomerate, the heavy isomerate, and the reformate to form a gasoline blend, wherein the gasoline blend has a target octane rating of at least 90.

2. The process as claimed in claim 1, wherein the light naphtha comprises paraffins having 5 or 6 carbon atoms.

3. The process as claimed in claim 1, wherein the heavy n-paraffin comprises paraffins having more than 6 carbon atoms and less than 13 carbon atoms.

4. The process as claimed in claim 1, wherein the heavy non-paraffin comprises non-paraffins having more than 6 carbon atoms and less than 13 carbon atoms.

5. The process as claimed in claim 1, wherein the heavy n-paraffin comprises paraffins having more than 6 carbon atoms and less than 12 carbon atoms.

6. The process as claimed in claim 1, wherein the heavy non-paraffin comprises non-paraffins having more than 6 carbon atoms and less than 12 carbon atoms.

7. The process as claimed in claim 1, wherein the heavy n-paraffin comprises paraffins having more than 6 carbon atoms and less than 11 carbon atoms.

8. The process as claimed in claim 1, wherein the heavy non-paraffin comprises non-paraffins having more than 6 carbon atoms and less than 11 carbon atoms.

9. The process as claimed in claim 1, wherein the heavy n-paraffin stream is separated from the heavy naphtha stream using molecular sieve adsorption, distillation, extraction, or combinations thereof.

10. The process as claimed in claim 1, wherein the heavy isomerate comprises branched paraffins, such that the heavy isomerate contains more branched paraffins as compared to the heavy n-paraffin.

11. The process as claimed in claim 1, further comprising introducing at least a portion of the reformate to a refinery as an aromatics source.

12. The process as claimed in claim 1, wherein the gasoline blend has improved characteristics, characterized by an octane rating within the range of 90 to 97, an aromatic concentration below 35% by volume, and a benzene concentration below 0.8% by volume.

13. The process as claimed in claim 1, wherein the first isomerization conditions include the first isomerization unit maintaining a first isomerization temperature within the range of 100 and 300° C., and the first isomerization unit maintaining a first isomerization pressure range within 275 and 450 psig.

14. The process as claimed in claim 1, wherein the second isomerization conditions include the second isomerization unit maintaining a second isomerization temperature within the range of 100 and 300° C., and the second isomerization unit maintaining a second isomerization pressure within the range of 300 and 700 psig.

15. The process as claimed in claim 1, wherein the reforming conditions include the reforming unit maintaining a reforming temperature within the range of 450° C. and 550° C., and the reforming unit maintaining a reforming pressure range within 70 and 300 psig.

16. The process as claimed in claim 1, wherein the gasoline blend comprises less than 35% by volume aromatics.

17. A process for refining naphtha, the process comprising the steps of:

(a) separating a naphtha feed into a light naphtha and a heavy naphtha, wherein the light naphtha comprises paraffins having 5 or 6 carbon atoms;

(b) introducing the light naphtha to a first isomerization unit under first isomerization conditions to produce a light isomerate, wherein the first isomerization conditions comprise a first isomerization temperature within the range of 100 and 300° C. and a first isomerization pressure within the range of 275 and 450 psig;

(c) separating the heavy naphtha into a heavy n-paraffin and a heavy non-paraffin, wherein the heavy non-paraffin comprises non-paraffins having more than 6 carbon atoms and less than 11 carbon atoms, wherein the heavy n-paraffin comprises paraffins having more than 6 carbon atoms and less than 11 carbon atoms;

(d) introducing the heavy n-paraffin to a second isomerization unit under second isomerization conditions to produce a heavy isomerate, wherein the heavy isomerate comprises branched paraffins having increased octane values as compared to the heavy n-paraffin, wherein the second isomerization conditions comprise a second isomerization temperature within the range of 100 and 300° C. and a second isomerization pressure within the range of 300 and 700 psig;

(e) introducing the heavy non-paraffin stream to a reforming unit under reforming conditions to produce a reformate, wherein the reforming conditions comprise a reforming temperature within the range of 450 and 550° C. and a reforming pressure within the range of 70 and 300 psig; and (f) combining at least a portion of each of the light isomerate, the heavy isomerate, and the reformate to form a gasoline blend, wherein the gasoline blend has improved characteristics, characterized by an octane rating within the range of 90 to 97, an aromatic concentration below 35% by volume, and a benzene concentration below 0.8% by volume.

18. The process as claimed in claim 17, wherein the heavy n-paraffin stream is separated from the heavy naphtha stream using molecular sieve adsorption, distillation, extraction, or combinations thereof.

* * * * *